US010520267B1

(12) United States Patent
Viani

(10) Patent No.: US 10,520,267 B1
(45) Date of Patent: Dec. 31, 2019

(54) ERGONOMIC SELF-CLEANING BASE PLATE

(71) Applicant: Arthur J. Viani, Miami, FL (US)

(72) Inventor: Arthur J. Viani, Miami, FL (US)

( * ) Notice: Subject to any disclaimer, the term of this patent is extended or adjusted under 35 U.S.C. 154(b) by 114 days.

(21) Appl. No.: 15/685,518

(22) Filed: Aug. 24, 2017

(51) Int. Cl.
*F41A 9/65* (2006.01)
*F41A 9/21* (2006.01)
*F41A 9/23* (2006.01)

(52) U.S. Cl.
CPC *F41A 9/65* (2013.01); *F41A 9/21* (2013.01); *F41A 9/23* (2013.01)

(58) Field of Classification Search
CPC ..... F41A 9/65
USPC ..... 42/50
See application file for complete search history.

(56) References Cited

U.S. PATENT DOCUMENTS

2005/0011097 A1* 1/2005 Freed ..... F41A 9/65 42/49.02
2008/0190003 A1* 8/2008 Bolen ..... F41A 9/61 42/50
2013/0333261 A1* 12/2013 Clifton, Jr. ..... F41A 9/65 42/50
2014/0047751 A1* 2/2014 Lee ..... F41A 9/65 42/49.01

* cited by examiner

*Primary Examiner* — J. Woodrow Eldred
(74) *Attorney, Agent, or Firm* — Albert Bordas, P.A.

(57) ABSTRACT

An ergonomic self-cleaning base plate, which has an exterior face with a perimeter edge. Extending from the perimeter edge is a forward face and an aft section. The magazine floor plate further has an interior face having at least one channel that extends from the forward face to the aft section. Debris accumulated within the at least one channel exits therefrom via the aft section. The forward face extends to an edge and has at least one channel hole. The at least one channel hole aligns with a respective at least one channel. The debris accumulated within the at least one channel also exits from the at least one channel hole.

13 Claims, 6 Drawing Sheets

PRIOR ART

ERGONOMIC SELF-CLEANING BASE PLATE

BACKGROUND OF THE INVENTION

1. Field of the Invention

The present invention relates to magazines for firearms, and more particularly, to ergonomic self-cleaning base plates.

2. Description of the Related Art

Applicant is not aware of any prior art suggesting the novel features of the present invention.

SUMMARY OF THE INVENTION

The present invention is an ergonomic self-cleaning base plate, also defined as a magazine floor plate. The magazine floor plate comprises an exterior face having a perimeter edge. Extending from the perimeter edge is a forward face and an aft section. The magazine floor plate further comprises an interior face having at least one channel that extends from the forward face to the aft section. Debris accumulated within the at least one channel may exit therefrom via the aft section. The exterior face is convexly shaped and comprises a hole that extends to the interior face. The exterior face further has at least one indent. The forward face extends to an edge and comprises at least one channel hole. The at least one channel hole aligns with a respective at least one channel. The debris accumulated within the at least one channel may also exit from the at least one channel hole. The forward face is positioned opposite of the aft section. First and second side faces extend from the perimeter edge and each comprises a grip section that in a preferred embodiment is concavely shaped. The edge defines a lip, which makes a U-shape configuration. The lip extends a predetermined distance from the edge and comprises first and second lip notches. The lip defines a side channel, which receives a base edge of a magazine tube.

It is therefore one of the main objects of the present invention to provide an ergonomic self-cleaning base plate.

It is another object of this invention to provide an ergonomic self-cleaning base plate comprising at least one channel.

It is another object of this invention to provide an ergonomic self-cleaning base plate in which debris accumulated in the at least one channel may exit therefrom.

It is another object of this invention to provide an ergonomic self-cleaning base plate in which debris accumulated in the at least one channel exits therefrom via an aft section.

It is another object of this invention to provide an ergonomic self-cleaning base plate in which debris accumulated in the at least one channel exits therefrom via the at least one channel hole.

It is another object of this invention to provide an ergonomic self-cleaning base plate, which is of a durable and reliable construction.

It is yet another object of this invention to provide an ergonomic self-cleaning base plate that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
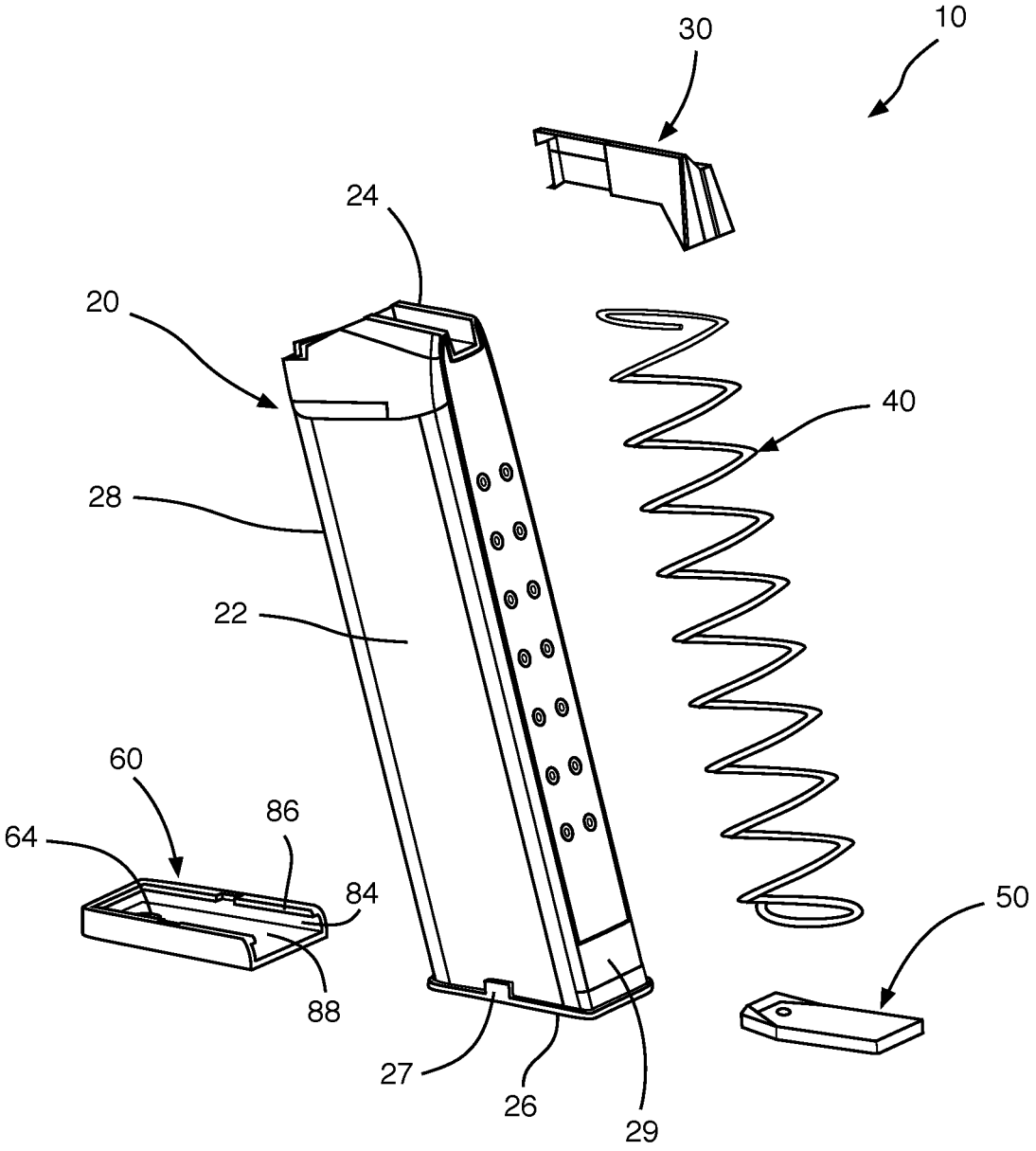
FIG. 1 represents a prior art magazine assembly.

Referring now to the drawings, the present invention is an ergonomic self-cleaning base plate that is also defined as a magazine floor plate, and is generally referred to with numeral 160.

As seen in FIG. 1, prior art magazine assembly 10 comprises magazine tube 20 having sidewall 22, top edge 24, and base edge 26 having protrusions 27. Magazine tube 20 further has magazine forward face 28 and magazine aft face 29. Prior art magazine assembly 10 further comprises follower 30, magazine spring 40, magazine insert 50, and magazine floor plate 60. Magazine floor plate 60 comprises hole 64, side channel 84 that is defined by lip 86, and interior face 88.

Figure 2:
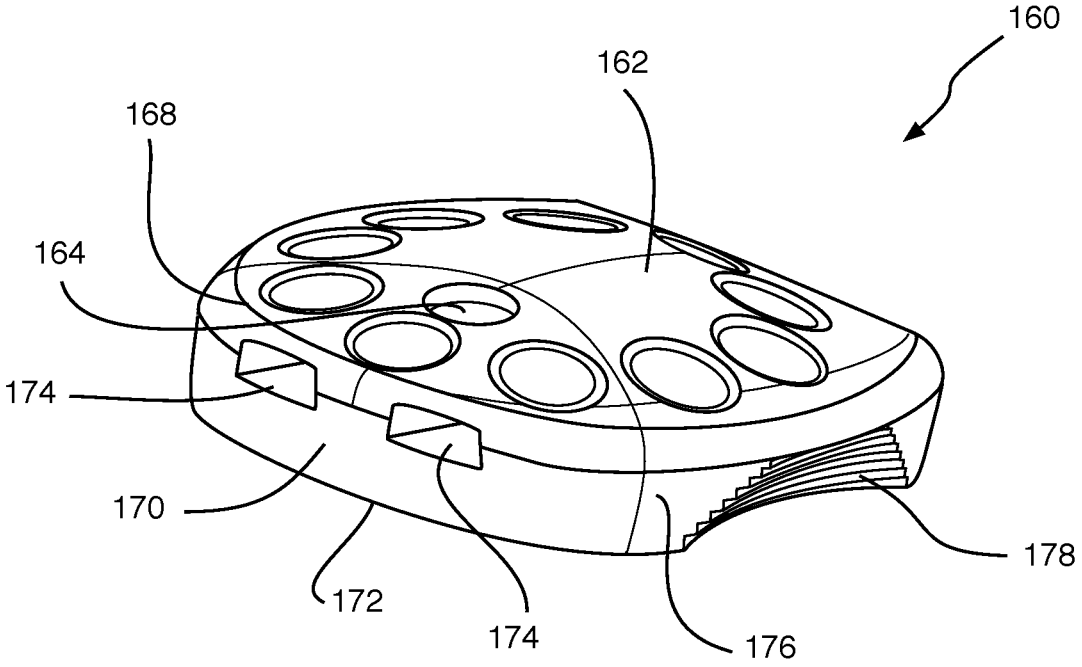
FIG. 2 is a first isometric view of a magazine floor base.
Figure 3:
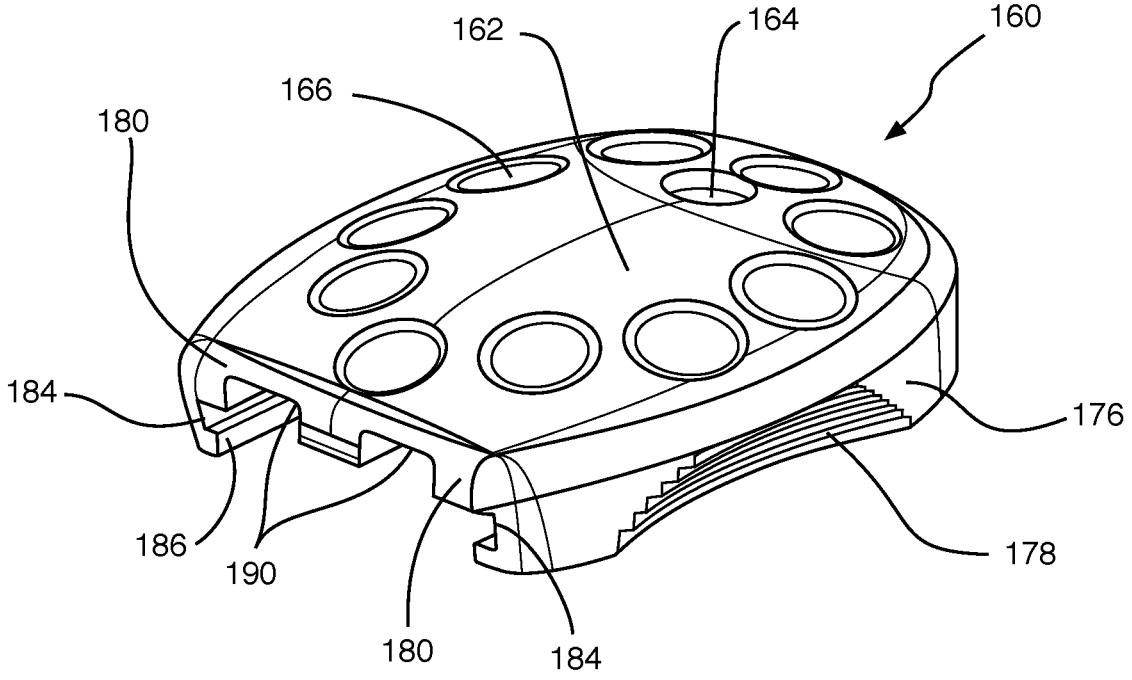
FIG. 3 is a second isometric view of the magazine floor base.

As seen in FIGS. 2 and 3, magazine floor plate 160 comprises exterior face 162 having perimeter edge 168. Extending from perimeter edge 168 is forward face 170 and aft section 180. Exterior face 162 is convexly shaped and comprises at least one indent 166. Forward face 170 extends to edge 172 and comprises at least one channel hole 174. In a preferred embodiment, there are first and second channel holes 174. Forward face 170 is positioned opposite to aft section 180. First and second side faces 176 extend from perimeter edge 168. Edge 172 defines lip 186, which extends a predetermined distance from edge 172. Lip 186 defines side channels 184 to receive base edge 26, as seen in FIG. 5.

Figure 4:
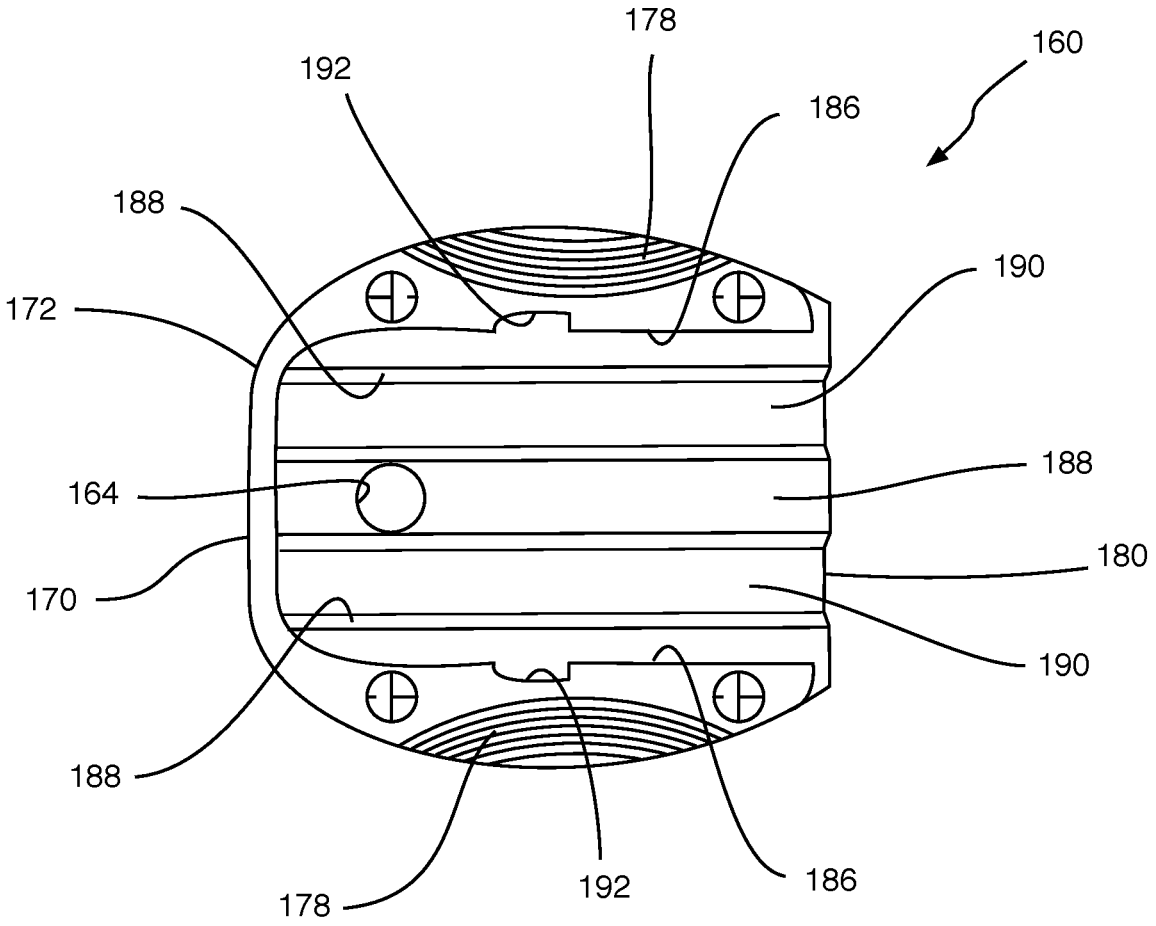
FIG. 4 is an elevational view of an interior face of the magazine floor base.

As seen in FIG. 4, magazine floor plate 160 further comprises interior face 188. Interior face 188 has at least one channel 190 that extends from forward face 170 to aft section 180. At least one channel 190 is designed to minimize debris accumulation. At least one channel hole 174, seen in FIG. 2, aligns with a respective at least one channel 190. In a preferred embodiment, there are first and second channels 190 corresponding to respective first and second channel holes 174. Lip 186 makes a U-shape configuration around edge 172. Lip 186 comprises first and second lip notches 192 to receive protrusions 27 of base edge 26, both seen in FIG. 1.

Figure 5:
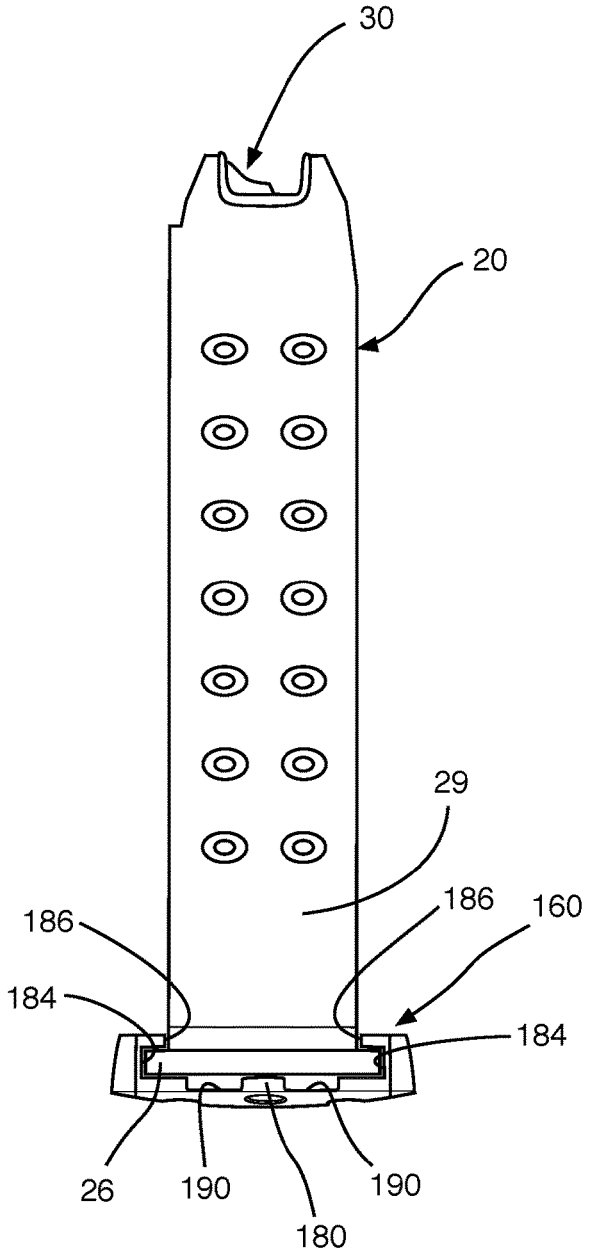
FIG. 5 is a rear isometric view of the magazine floor base secured onto a magazine tube.
Figure 6:
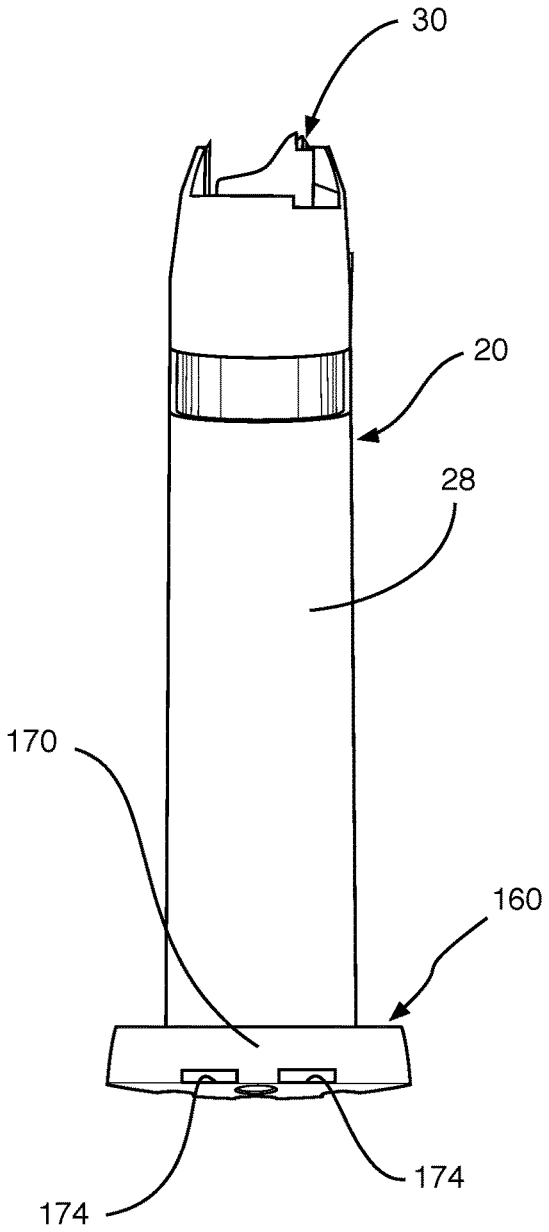
FIG. 6 is a front isometric view of the magazine floor base secured onto the magazine tube.

As seen in FIGS. 5 and 6, magazine floor plate 160 is mounted onto magazine tube 20. Side channels 184 receive base edge 26, whereby magazine forward face 28 corresponds with forward face 170, and magazine aft face 29 corresponds with aft face 180. First and second channels 190 and base edge 26 define two openings at aft section 180, which respectively align with first and second channel holes 174.

Any debris, not seen, that is produced and/or accumulates within magazine tube 20 and falls and/or accumulates onto first and second channels 190, may exit therefrom via the openings formed at aft section 180, and/or through first and second channel holes 174. Therefore, magazine floor plate 160 promotes and/or functions as self-cleaning. Debris, as an example may be, but is not limited to, dirt, oil, sand, powder, carbon, and/or shavings, or combinations thereof.

Figure 7:
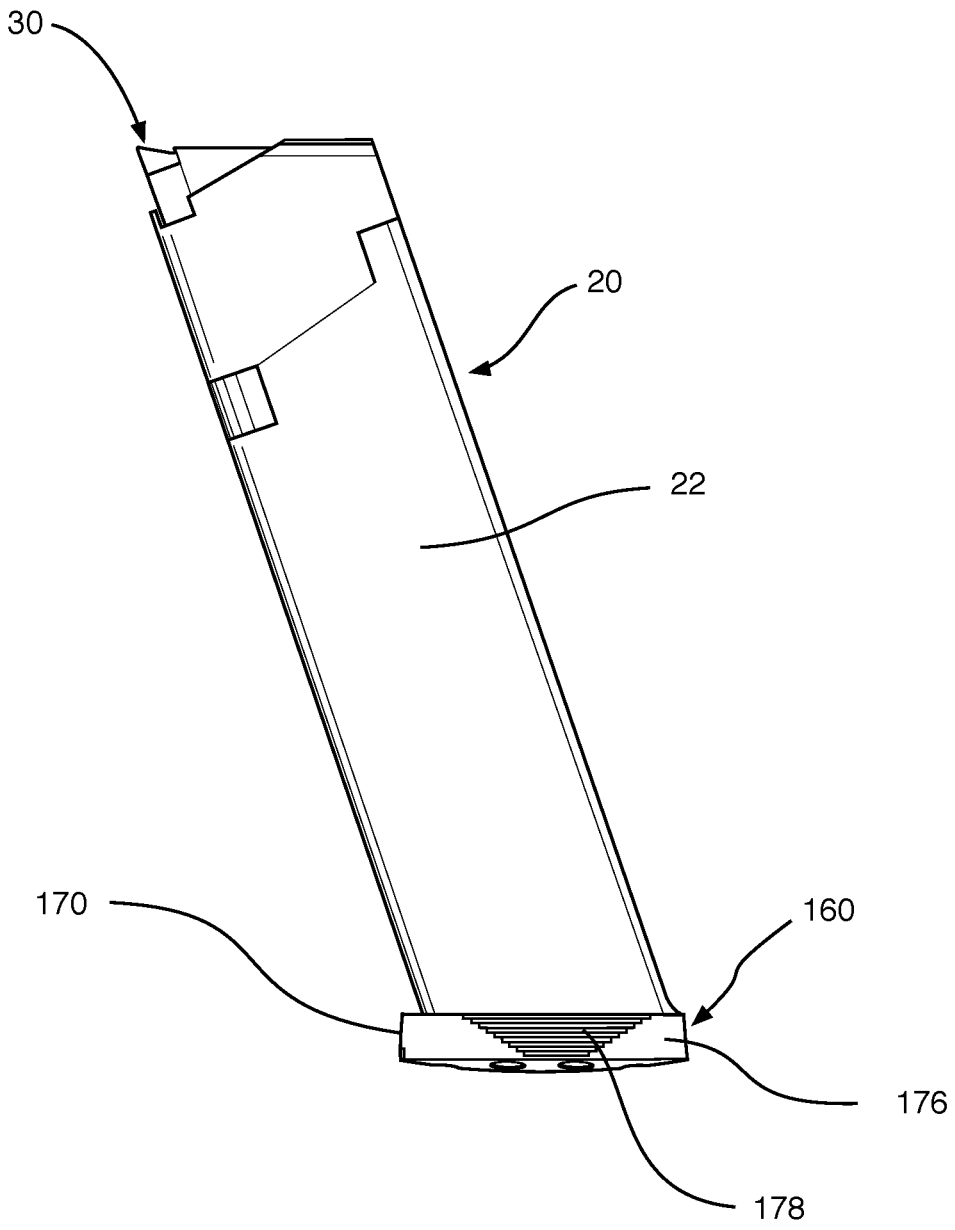
FIG. 7 is a left side view of the magazine floor base secured onto the magazine tube.

As seen in FIG. 7, sidewalls 22 of magazine tube 20 correspond with respective first and second side faces 176 of magazine floor plate 160. First and second side faces 176 each comprise grip section 178. Grip section 178 is ergonomically shaped, and in a preferred embodiment, is concavely shaped to facilitate grasping and/or handling of magazine floor plate 160, especially when securing it onto, or removing it from, magazine tube 20.

Figure 8:
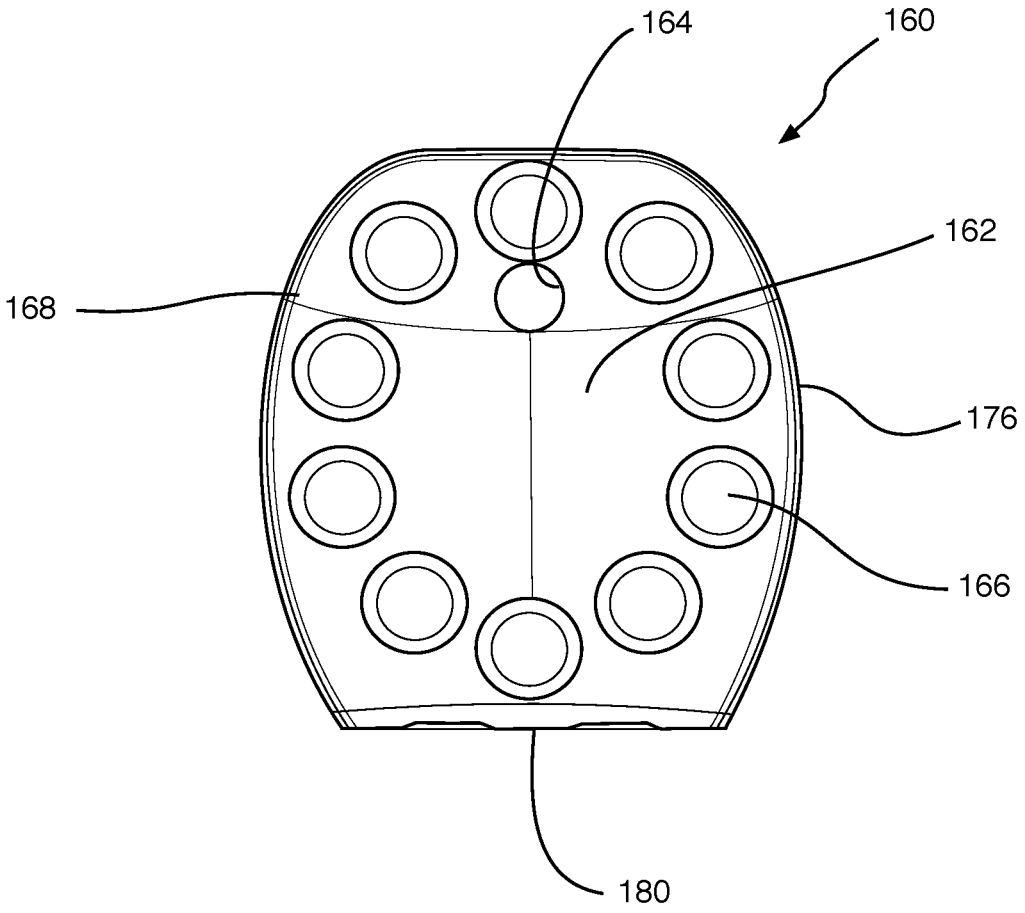
FIG. 8 is a top view of the magazine floor base.

As seen in FIG. 8, exterior face 162 of magazine floor plate 160 comprises hole 164. Hole 164 extends from exterior face 162 to interior face 188, seen in FIG. 4. Hole 164 receives a protrusion protruding from magazine insert 50, not seen, when magazine floor plate 160 covers magazine insert 50, seen in FIG. 1, and the magazine assembly is assembled. Exterior face 162 further comprises at least one indent 166. In a preferred embodiment, exterior face 162 comprises several indents 166, allowing for better friction when magazine floor plate 160 is handled. In alternate embodiments, exterior face 162 may comprise a plurality of protrusions on its surface, or be hatched, or otherwise be textured or rough for better friction when magazine floor plate 160 is handled.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An ergonomic self-cleaning base plate comprising an exterior face having a perimeter edge, extending from said perimeter edge is a forward face comprising at least one channel hole and an aft section, and further comprising an interior face having at least one channel that extends from said forward face to said aft section, by gravity debris is accumulated within said at least one channel, and said debris is able to exit via said at least one channel at said aft section and said at least one channel hole, said forward face extends to an edge, said edge defines a lip, said lip defines a side channel, said side channel receives a base edge of a magazine tube.

2. The ergonomic self-cleaning base plate set forth in claim 1, further characterized in that said exterior face comprises a hole that extends to said interior face.

3. The ergonomic self-cleaning base plate set forth in claim 1, further characterized in that said exterior face comprises at least one indent.

4. The ergonomic self-cleaning base plate set forth in claim 1, further characterized in that said exterior face is convexly shaped.

5. The ergonomic self-cleaning base plate set forth in claim 1, further characterized in that said at least one channel hole aligns with a respective said at least one channel.

6. The ergonomic self-cleaning base plate set forth in claim 1, further characterized in that debris accumulated within said at least one channel is able to exit therefrom.

7. The ergonomic self-cleaning base plate set forth in claim 1, further characterized in that said forward face is positioned opposite of said aft section.

8. The ergonomic self-cleaning base plate set forth in claim 1, further characterized in that first and second side faces extend from said perimeter edge.

9. The ergonomic self-cleaning base plate set forth in claim 8, further characterized in that said first and second side faces each comprise a grip section.

10. The ergonomic self-cleaning base plate set forth in claim 9, further characterized in that each said grip section is concavely shaped.

11. The ergonomic self-cleaning base plate set forth in claim 1, further characterized in that said lip makes a U shape configuration.

12. The ergonomic self-cleaning base plate set forth in claim 1, further characterized in that said lip comprises first and second lip notches.

13. The ergonomic self-cleaning base plate set forth in claim 1, further characterized in that said lip extends a predetermined distance from said edge.

* * * * *